US007363799B2

(12) United States Patent
Hamm et al.

(10) Patent No.: US 7,363,799 B2
(45) Date of Patent: Apr. 29, 2008

(54) DUAL OPERATION CRIMP AND PRESS JAWSET

(75) Inventors: James E. Hamm, Grafton, OH (US); Richard W. Ballas, Vermillion, OH (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 11/492,361

(22) Filed: Jul. 25, 2006

(65) Prior Publication Data

US 2008/0022750 A1 Jan. 31, 2008

(51) Int. Cl.
*H01R 43/042* (2006.01)
*B21D 28/10* (2006.01)

(52) U.S. Cl. ..... 72/452.8; 72/453.16; 81/313

(58) Field of Classification Search ..... 72/402, 72/407, 410, 416, 452.8, 452.15; 81/313, 81/345; 29/237

See application file for complete search history.

(56) References Cited

U.S. PATENT DOCUMENTS

| | | | |
|---|---|---|---|
| 1,084,935 | A | 1/1914 | Flora et al. |
| 1,105,191 | A | 7/1914 | Flora et al. |
| 1,498,488 | A | 6/1924 | Stallings |
| 1,653,340 | A | 12/1927 | Carolus |
| 2,086,400 | A | 7/1937 | Brenizer |
| 2,244,482 | A | 6/1941 | Baxter et al. |
| 2,614,304 | A | 1/1952 | Oetiker |
| 2,735,322 | A | 2/1956 | Meisler |
| 2,747,446 | A | 5/1956 | Eder |
| 2,910,900 | A | 11/1959 | Klein |
| 3,216,291 | A | 11/1965 | Madeira |
| 3,257,874 | A | 6/1966 | Madeira |

(Continued)

FOREIGN PATENT DOCUMENTS

| | | |
|---|---|---|
| DE | 32 47 073 | 3/1984 |
| DE | 36 17 834 | 3/1987 |

*Primary Examiner*—David B Jones

(74) *Attorney, Agent, or Firm*—Rankin, Hill & Clark LLP

(57) ABSTRACT

A jawset for crimping and punching an associated clamping workpiece has a pair of spaced apart side plates, a pair of pivot pins holding a pair of jawarms between the side plates, tooth members formed on the jawarms to crimp an associated clamp ring workpiece in a first direction, and a punch member slidable in the jawset relative to the jawarms to punch the associated workpiece in a second direction transverse the first direction. In one form, a timing disk is provided extending between the jawarms and through the slidable punch member. A biasing member is provided for urging the jawarms in an opening direction opposite the crimping direction. A workpiece alignment area is defined by a region of the spaced apart side plates for enabling relative alignment between the jawset and the associated workpiece. In a further embodiment, a pair of auxiliary side plates are carried adjacent ruggedized side plates for enabling an alignment area without adding undue weight or cost to the jawset. In a further embodiment, the jawarms are provided with stop members forward of the pivot pins including inwardly directed abutment surfaces for controlling a closure amount of the tooth members during the crimping operation. Still further, the punch member selectively provides both a hard stop during the crimping operation as well as a movable punch during the pressing operation based on a relative size of the workpiece.

39 Claims, 13 Drawing Sheets

U.S. PATENT DOCUMENTS

| | | | | | |
|---|---|---|---|---|---|
| 3,345,856 | A | | 10/1967 | Werner et al. | |
| 3,402,436 | A | | 9/1968 | Oetiker | |
| 3,704,620 | A | | 12/1972 | Allen | |
| 3,706,219 | A | | 12/1972 | Hoffman et al. | |
| 4,109,504 | A | * | 8/1978 | Rommel | 72/407 |
| 4,111,022 | A | | 9/1978 | Kruschel | |
| 4,480,460 | A | * | 11/1984 | Bush et al. | 72/409.01 |
| 4,610,187 | A | | 9/1986 | Spaulding | |
| 4,633,558 | A | | 1/1987 | Spaulding | |
| 4,724,729 | A | | 2/1988 | Oetiker | |
| 4,742,736 | A | | 5/1988 | Williams | |
| 4,751,862 | A | | 6/1988 | Winfrey | |
| 4,884,432 | A | | 12/1989 | Watson | |
| 4,987,652 | A | | 1/1991 | Spaulding | |
| 5,070,580 | A | | 12/1991 | Oetiker | |
| 5,195,353 | A | | 3/1993 | Erbrick et al. | |
| 5,282,295 | A | | 2/1994 | Oetiker | |
| 5,335,531 | A | * | 8/1994 | Mann et al. | 72/416 |
| 5,410,903 | A | | 5/1995 | Schneider | |
| 5,653,140 | A | * | 8/1997 | West | 72/452.8 |
| 5,669,113 | A | | 9/1997 | Fay | |
| 5,839,316 | A | * | 11/1998 | Kolivoski et al. | 72/452.8 |
| 6,044,686 | A | * | 4/2000 | Dischler | 72/402 |
| 6,125,684 | A | * | 10/2000 | Moilanen et al. | 81/313 |
| 6,226,874 | B1 | | 5/2001 | Jansson | |
| 6,434,998 | B2 | | 8/2002 | Amherd | |
| 7,000,448 | B2 | | 2/2006 | Hamm et al. | |
| 7,155,955 | B2 | * | 1/2007 | Bowles et al. | 72/453.16 |
| 2003/0167881 | A1 | | 9/2003 | Chauffeteau et al. | |

* cited by examiner

DUAL OPERATION CRIMP AND PRESS JAWSET

BACKGROUND

The present exemplary embodiments relate to the art of clamp installation tools and, more particularly, to jawsets for fastening associated clamps, rings and other devices onto objects such as pipes, tubes or the like. The embodiments find application in conjunction with crimping and punching stainless steel clamp rings, and will be described with particular reference thereto. However, it is to be appreciated that the present exemplary embodiments are also amenable to other like applications.

The steel clamp rings of interest herein are commonly referred to as "Oetiker" rings which have been used in a wide variety of applications for many years. Those clamp rings have portions which are adapted for crimping and/or pressing in order to tighten the ring around a cylindrical workpiece such as may be required as attaching a hose to a coupling, fitting, or the like.

In the past, specialized tools have been developed for crimping and/or punching Oetiker rings. Some of these specialized tools have been provided with a fixed backstop for ensuring that the crimp portion of the ring maintains a flattened or less rounded profile. Among these, U.S. Pat. Nos. 4,884,432 to Watson and 3,402,436 to Oetiker show plier type devices with hard permanent backstops for limiting inward migration of the crimped portion of the ring into the working area of the tool.

U.S. Pat. No. 5,195,353 to Erbrick, et al. shows a tool for crimping Oetiker clamp rings with a fixed backstop as well but, in the '353 patent, the fixed backstop is adjustable.

Other tools have been proposed as well. A large manually operated tool having a linkage driven plunger is taught in U.S. Pat. No. 4,111,022 to Kruschel and a hydraulic or pneumatically operated clamp gun with an external plunger providing a movable backstop is shown in U.S. Pat. No. 5,410,903 to Schneider.

It would be desirable, however, to have a jawset operable in connection with a "universal" pressing tool whereby the jawset effects a crimping and pressing operation on Oetiker ring-type clamps.

It would further be desirable to provide such a jawset with a punch member adapted to perform both a fixed stop operation as well as a movable punch or pressing operation on clamp ring workpieces of the type described above.

BRIEF DESCRIPTION

In accordance with the present application, a jawset is provided having tooth members used to effect a crimp operation on an associated clamp ring workpiece and having a slidable punch member for effecting a punching operation on the associated workpiece. The jawset generally includes a pair of spaced apart side plates defining a gap therebetween and a pair of pivot pins extending transversely between the side plates. A pair of jawarms are disposed between the pair of side plates in the gap and include pivot pin openings receiving the pivot pins between the side plates. Each jawarm has an inner and outer edge laterally spaced from and extending forwardly, along, and rearwardly of the corresponding pivot pin openings. The inner edges of the jawarms include laterally inwardly directed tooth members and laterally inwardly open opposed jaw recesses forwardly of the pin openings and inwardly facing cam surfaces rearwardly of the openings. The jawarms during use of the jawset are pivotally movable about the pivot pins in response to forces laterally outwardly against the cam surfaces to displace the tooth members laterally inwardly in a closing direction to crimp the associated clamp ring workpiece in a first crimping direction. The punch member extends between the pair of side plates and between the pair of jawarms and includes a distal end defining an elongate slot and an enlarged proximal end. The punch member, during use of the jawset, is movable forwardly in response to a second force forwardly against the enlarged proximal end thereof to slide the distal end forwardly along the inner edges of the pair of jawarms to punch the associated workpiece in a second direction transverse the crimping or first direction. Lastly, a timing disk is carried in opposed first and second recesses formed in the inner edges of the pair of jawarms and extends in the longitudinal slot defined by the punch member. The timing disk is used for coordinating and synchronizing relative movement of the pair of jawarms when one of the pair of jawarms is rotated relative to the other of the pair of jawarms in response to the first forces laterally outwardly against the cam surfaces.

In one form of the punch member, the elongate slot is defined by spaced apart shoulder portions of the distal end of the punch member. The first shoulder portion defines an outer surface adapted to slidably engage a first side plate of the pair of side plates, and an inner surface opposite from the outer surface and configured to slidably engage a first side of the timing disk. Further, the second shoulder portion defines an outer surface adapted to slidably engage a second side plate of the pair of side plates, and an inner surface opposite from the outer surface and adapted to engage a second side of the timing disk opposite of the first side of the timing disk. As desired, the punch member is guided in the gap between the pair of spaced apart side plates defined by the timing disk in the elongate slot.

In another form, the jawset includes a biasing member operatively coupled with the pair of jawarms for urging the jawarms in an opening direction opposite from said closing or crimping direction. The biasing member is preferably a coil spring having a first end received in a recess formed in a first one of the pair of jawarms and a second end received in a further recess formed in a second one of the pair of jawarms. Still further, the elongate slot formed in the punch member is of sufficient size to accommodate the spring member extending therethrough and across into the recesses formed in the pair of opposed jawarms.

In accordance with a further aspect of the present application, the jawset further includes a workpiece alignment portion defined by the pair of spaced apart side plates in a region adjacent the tooth members of the pair of jawarms. The alignment portion is configured to expose a portion of the tooth members for visual inspection and for positioning the associated workpiece relative to the tooth members during use of the subject jawset. In one form, each of the side plates includes a pair of concave portions defined at edges thereof located forwardly of the pivot pins.

In accordance with yet a further aspect of the present application, the punch member includes an enlarge proximal end defining a set of pocket regions adapted to receive second forces delivered from an associated source such as a power tool or the like to selectively move the punch member forwardly into said punching engagement with the associate clamp ring workpiece. In one form, the set of pocket regions includes a pair of concave surfaces adapted to engage an associated set of roller members carried on the associated power tool for generating the second forces driving the jawarms outwardly on rear ends thereof and inwardly in said crimping direction on front ends thereof for the first crimping operation and for driving the punch member forwardly in said punching direction for said second or punching operation. Preferably, the concave surfaces are bi-laterally symmetrical about a plane extending along a longitudinal axis defined by the distal end of the punch member.

In accordance with yet a still further aspect of the present application, a pair of auxiliary side plates are carried on pivot pins adjacent a first set of ruggedized side plates on sides opposite the jawarm members. The pair of auxiliary side plates provide a workpiece alignment portion configured to expose a portion of the tooth members for visual inspection thereof and for positioning the associated workpiece relative to the tooth members during use of the subject jawset. The auxiliary sideplates are preferably of a lighter gauge steel or other material which may be transparent as desired for reducing the overall weight of the subject jawset while enabling an alignment portion for exposing the crimping and punching operations for visual inspection thereof and for providing relative alignment between the workpiece and the subject jawset. Preferably, each of the auxiliary side plates includes a pair of concave portions defined at edges thereof located forwardly of the pivot pins.

In accordance with yet a still further aspect of the present application, a stop member is carried on the pair of jaw members for limiting the lateral inward movement of the tooth members in the closing or crimping direction in order to control the first or crimping operation. In its preferred form, the stop member includes inwardly directed abutment surfaces carried on raised protuberances formed on the inner edges of the pair of jawarms forwardly of the pivot pin openings. Each of the jawarms carries a radiussed protuberance which extends through the elongate slot formed in the punch member. In their preferred form, each of the jawset arm members are elastically deformable in areas forwardly and rearwardly of the pin openings so that the rearward portions thereof can be deflected to a deflected condition to ensure that the abutment surfaces on the forward ends of the arms are in engagement for accommodating thereon the cam surfaces and the like during the crimping operation.

In accordance with still a further aspect of the present application, the punch member is provided with an elongate opening including opposed first and second concave stop surfaces adapted to engage an associated holding pin during use of the jawset whereby the first stop surface selectively engages the holding pin to limit rearward movement of the punch member relative to the jawarms in response to a workpiece reactionary force against the distal end thereof during a crimping operation to provide a hard stop against the workpiece, and the second stop surface selectively engages an opposite side of the associated holding pin member to limit forward movement of the punch member relative to the jawarms in response to an auxiliary force against the proximal end of the punch member during said pressing operation. As such, the movable punch member provides both a hard stop during a crimping operation as well as a movable pressing member.

In accordance with yet a still further aspect of the present application, a dual operation jawset is provided which enables a crimp operation followed by a pressing operation on an associated workpiece. In one form, the crimp and pressing operations overlap in time. In another form, the crimping operation completes before the pressing operation is initiated. In yet another form, an overlap between the crimping and pressing operations is selectively enabled based upon a relative size difference between components of the jawset and the associated workpiece.

In accordance with the above, therefore, the present application provides a jawset which enables a dual operation on an associated workpiece including a crimping operation and a punching operation particularly well suited for crimping and punching stainless steel clamp rings or the like.

DETAILED DESCRIPTION

Figure 1:
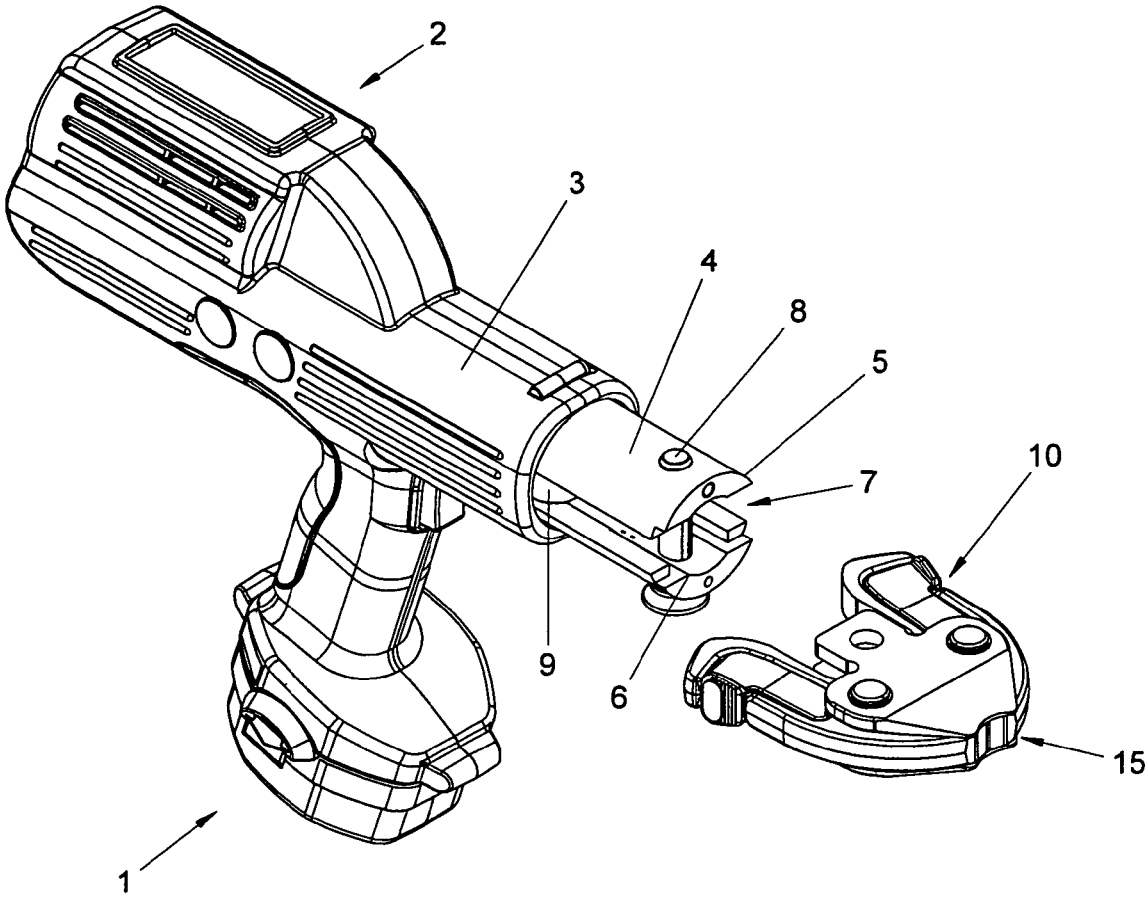
FIG. 1 is a perspective view of a crimping system including a pressing apparatus and a jawset configured to perform crimping and punching operations in accordance with the present invention.
Figure 9:
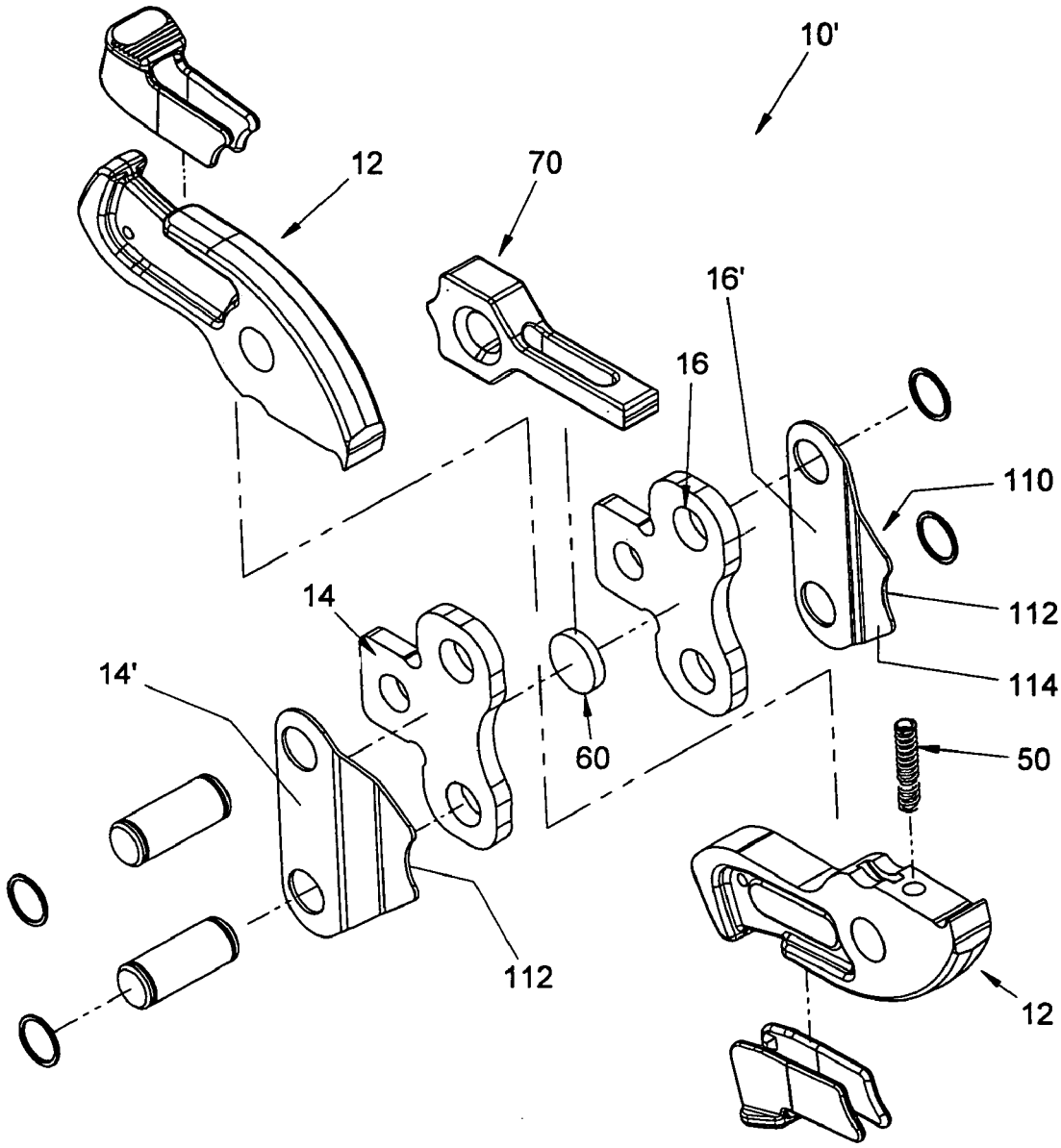
FIG. 9 is a perspective exploded view of a jawset formed in accordance with a second preferred embodiment.
Figure 10A:
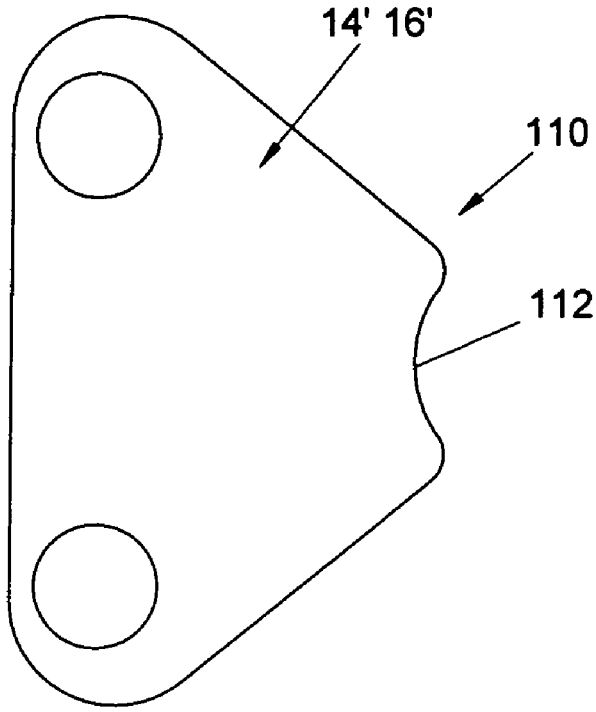
FIGS. 10*a* and 10*b* are top and front plan views, respectively, of a side plate used in the embodiment of FIG. 8.
Figure 10B:
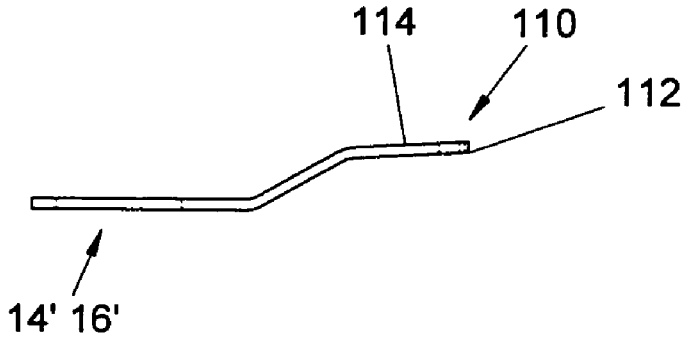
Figure 11A:
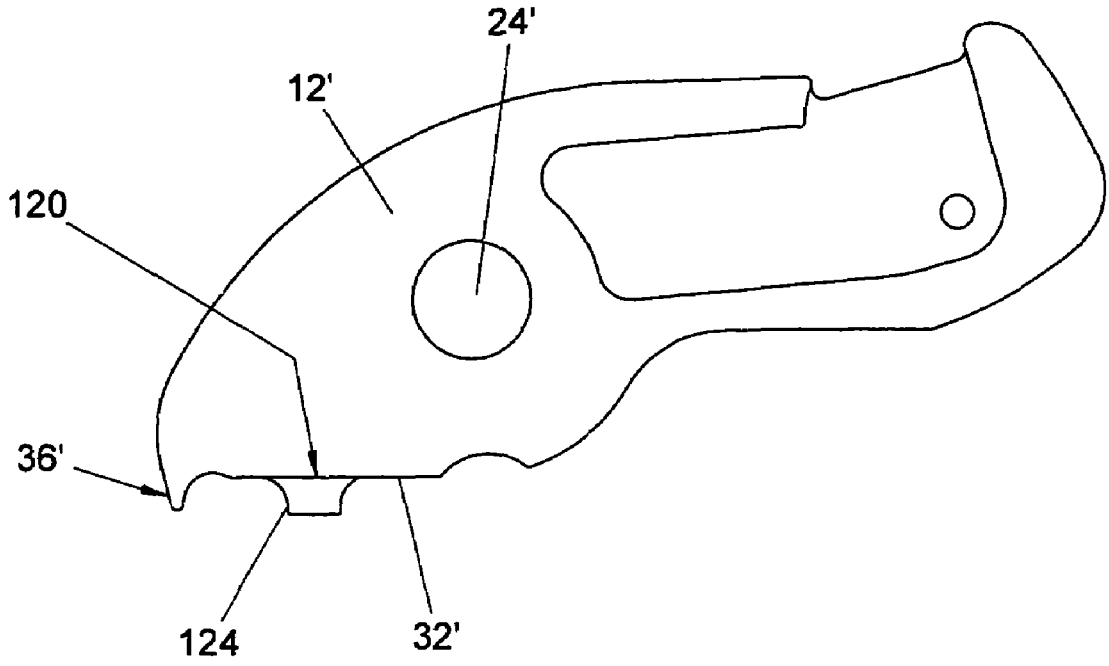
FIGS. 11*a* and 11*b* are top and side plan views of a jawarm member of a jawset in accordance with a third embodiment.
Figure 11B:
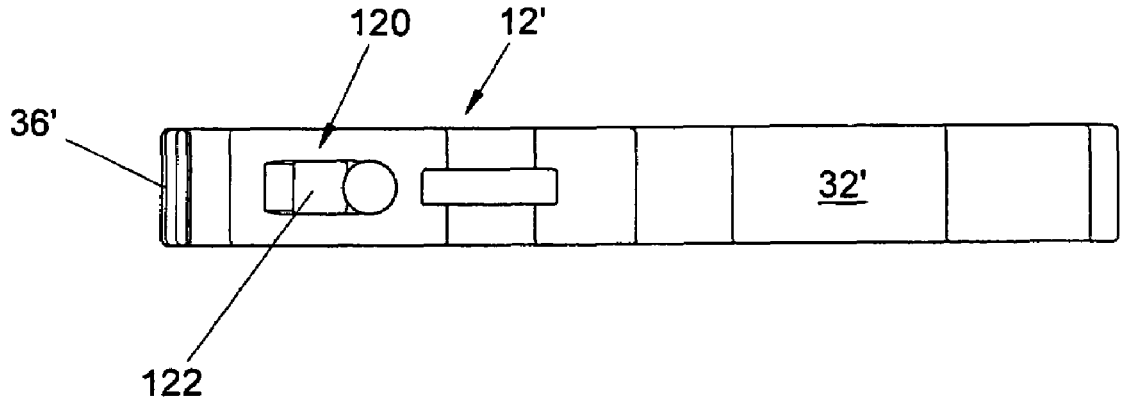
Figure 12:
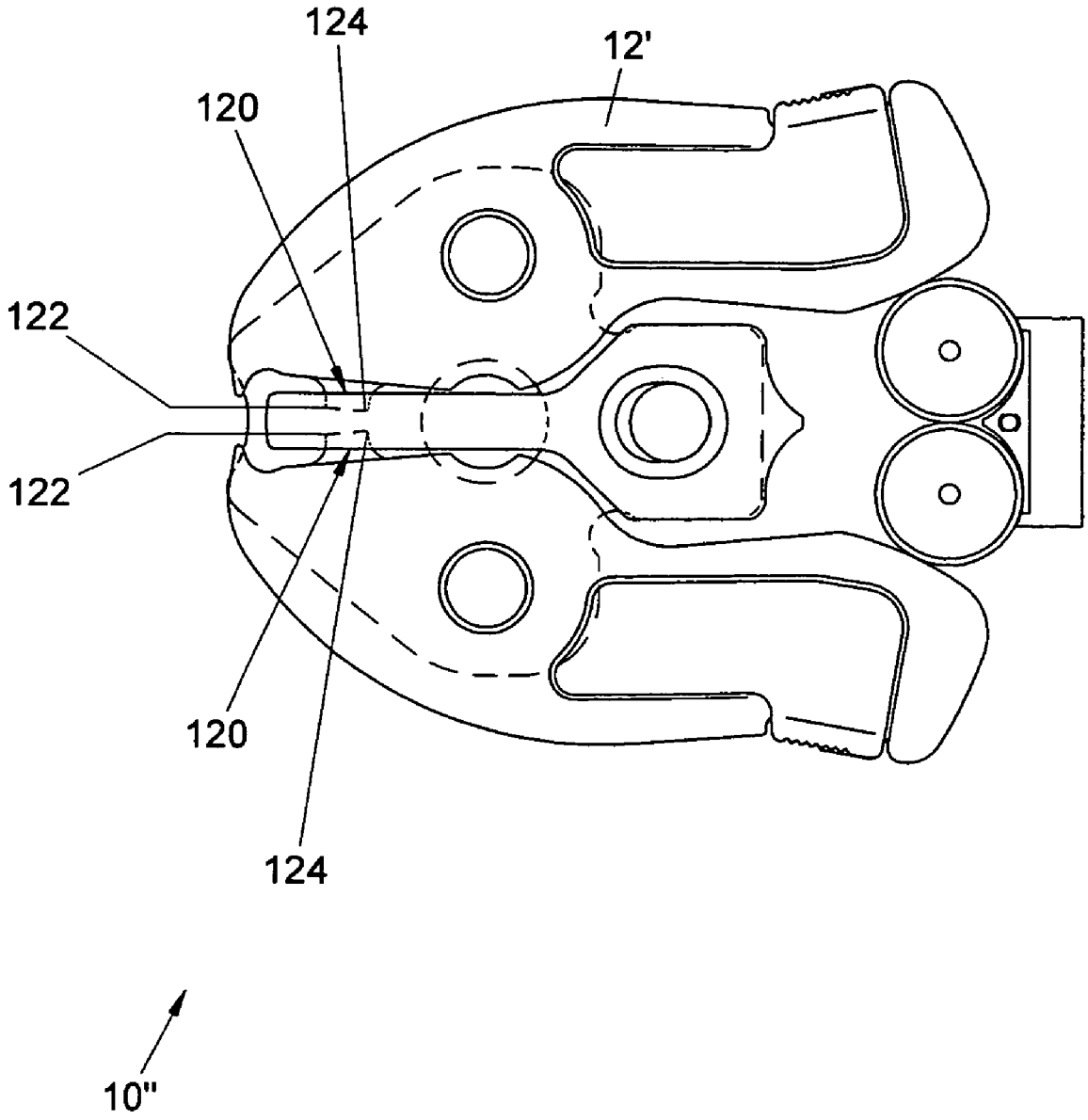
FIG. 12 is a top plan view of a third embodiment of the subject jawset using the jawarms of FIGS. 11*a* and 11*b* illustrated in a relaxed or open position prior to actuation; and, FIG. 13 is a plan view of the jawset of FIG. 12 illustrated in a close or actuated condition.

Referring now in greater detail to the drawings, wherein the showings are for the purposes of illustrating the preferred embodiments of the invention only, and not for purposes of limiting the invention, FIG. 1 shows a pressing unit together with a jawset in accordance with the present application. FIGS. 2-7*b* illustrate a first preferred embodiment of the jawset in accordance with the present application. FIGS. 9, 10*a*, and 10*b* illustrate a second preferred embodiment of the jawset in accordance with the present application. FIGS. 11*a*, 11*b*, 12, and 13 illustrate a third preferred embodiment of the jawset in accordance with the present application. FIGS. 8*a*-8*d* show a further embodiment useful with each of the above embodiments.

Turning first to FIG. 1, a crimping system 1 is illustrated including an associated pressing apparatus 2 together with a dual operation jawset 10 for crimping and punching in accordance with the present application, in a perspective top view. The associated pressing apparatus 2 includes a drive unit 3 and a connection unit 4 for connecting the drive unit with the jawset 10. The connection unit 4 includes a pair of opposed plates 5, 6 spaced apart to form a horizontal gap 7 therebetween. A vertically disposed connection bolt 8 extends transversely across the gap 7 between the upper and lower plates 5, 6 for connecting the jawset 10 with the pressing apparatus. A force generating member 9 is slidably carried at the connection unit 4 and is selectively movable by the drive unit 3 towards and away from the transverse connection bolt 8 in a direction out from and into the pressing apparatus along the gap 7 formed between the upper and lower plates 5, 6. As will be understood by those skilled in the art, the subject crimping and punching jawset 10 is selectively coupled with the pressing apparatus 2 in the overall system shown by sliding the connection bolt 8 out from the connection unit 3, inserting the jawset 10 into the gap 7 from an orientation substantially as shown, and, thereafter, reinstalling the connection bolt 8 back through the plates 5, 6 and through a portion of the jawset 10 thereby holding it in place. With the jawset 10 thus attached with the connection unit 4, movement of the force generating member 9 relative to the pin activates the jawset to effect a first crimping operation on an associated clamp type workpiece and a second pressing operation on the workpiece in a manner described below. A portion of the jawset 10 acts as a movable punch during the pressing operation and, selectively, as a fixed stop member during the crimping operation based on the selective sizes of the workpieces and jawset members.

Figure 2:
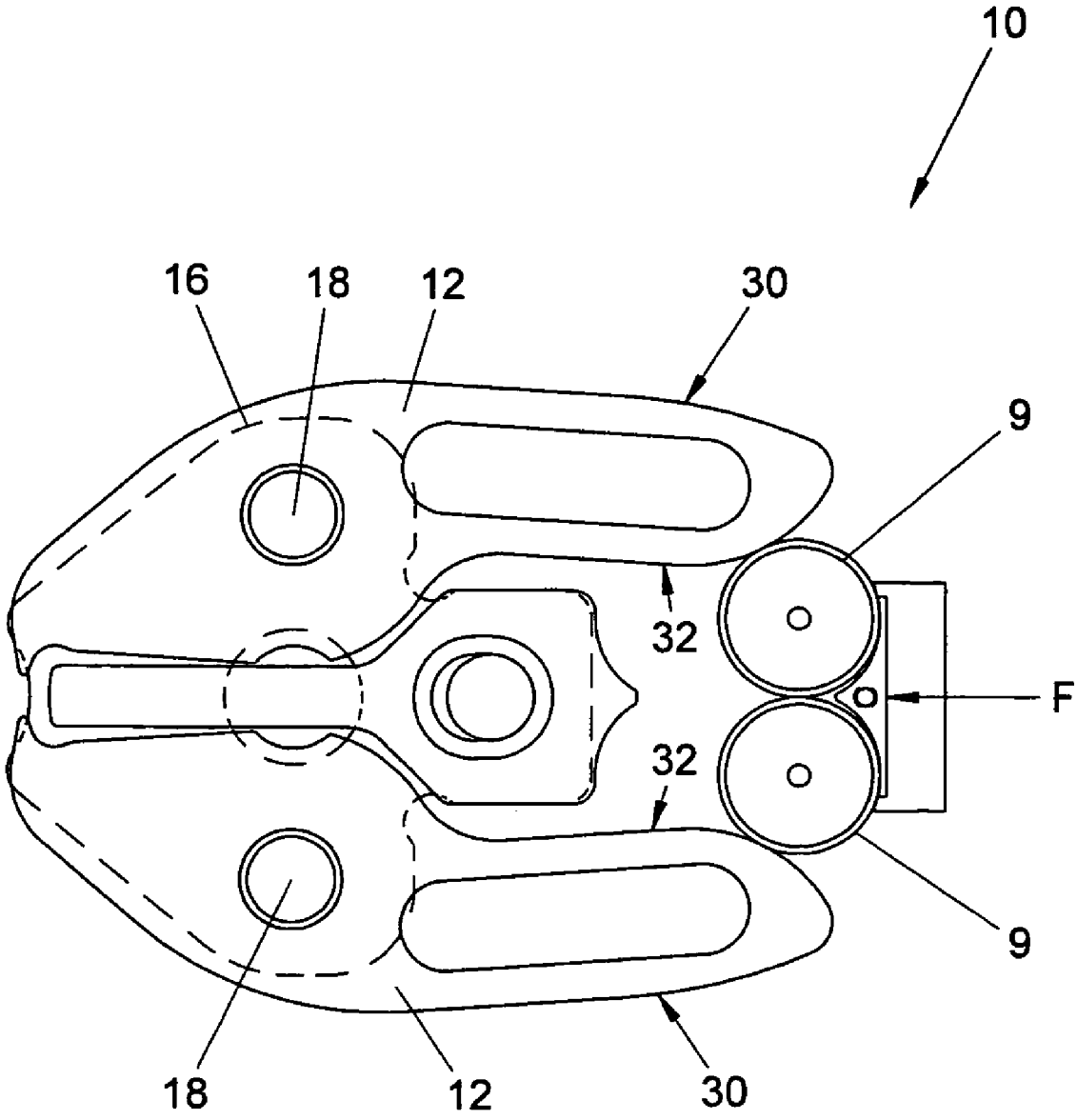
FIG. 2 is a top plan view of a first embodiment of the subject jawset illustrated in a relaxed or open position prior to actuation.
Figure 3:
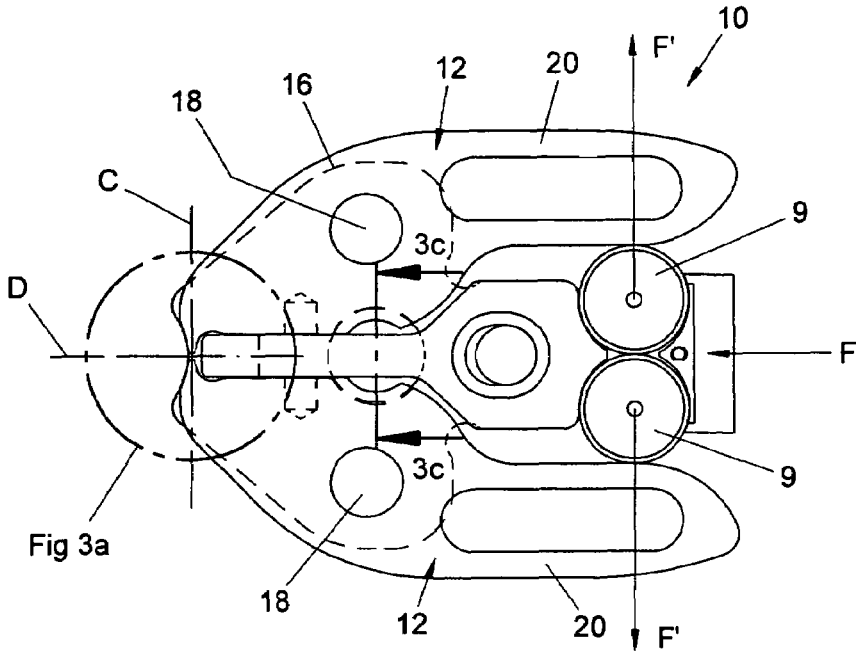
FIG. 3 is a plan view of the jawset of FIG. 2 illustrated in a closed or actuated condition.

FIGS. 2 and 3 show top plan views of a first embodiment of the subject jawset 10 during use thereof such as by use with the pressing apparatus 2 shown in FIG. 1 in a relaxed or opened position (FIG. 2) and in an actuated or closed position (FIG. 3). FIGS. 4-7*b* illustrate selected details of the components of the preferred jawset in accordance with the first embodiment. With reference to all of those figures, the first preferred embodiment of the subject jawset 10 comprises a pair of opposed jawarm members 12 mounted in the assembled jawset substantially in the orientation shown in FIGS. 2, 3, and 4. The jawarm members 12 are disposed in a gap 15 formed between spaced top and bottom side plates 14 and 16 (top side plate removed in FIGS. 2, 3, and 3*a*), respectively, and are pivotably coupled with the side plates 14, 16 by a corresponding pivot or bearing pin 18. More particularly, in this respect, each of the jawarm members 12 has a top side 20 and a bottom side 22 for slidably engaging the side plates 14, 16 and a pin opening 24 for receiving a corresponding pivot pin 18 therethrough. Side plates 14 and 16 are generally T-shaped and include laterally opposite sides 14*a* and 16*a*, respectively, which are provided with aligned holes 26 for receiving the outer ends of the corresponding pin 18. Side plates 14 and 16 further include rear ends 14*b* and 16*b*, respectively, which are provided with aligned openings 27 therethrough. The openings 27 are sized to snugly receive the connection bolt 8 of the pressing apparatus 2 described above by which the jawset 10 is selectively mounted to the connection unit 4 of the pressing apparatus 2. The connection unit 4 of the pressing apparatus 2 including the transverse connection bolt 8 mounting system is well-known in the art and other pressing tools can be attached to the connection unit in the gap 7 using the connection pin 8. However, in the present application, a punch member 70 disposed between the jawarms 12 and side plates 14, 16 includes a chamfered opening 71 to help lead the connection pin 8 through an opening formed in the punch member 70 in a manner to be described below. This is useful as the punch member is held in place between the jawarms and side plates loosely and exact alignment between the punch opening 71 and side plate openings 27 cannot be ensured. Still further, in one preferred embodiment, the side plates 14 and 16 further include front ends 14*c* and 16*c*, respectively, which are configured to define a workpiece alignment area 100 (FIGS. 3*a*, 3*b*) for providing relative alignment between associated clamp device workpieces and the jawset during use thereof in a manner to be described in greater detail below.

Each of the jawarm members 12 has longitudinally opposite front and rear ends 12*a* and 12*b*, respectively. The top and bottom sides 20 and 22 of the arms 12 are recessed rearwardly of pin opening 24 as indicated generally by numeral 12*c* with respect to the top side 20 in FIGS. 2-4. Each jawarm further includes laterally outer and inner edges 30 and 32, respectively, which are spaced from opening 24 and which extend forwardly and rearwardly of the opening. Inner edges 32 of the jawarm members provide laterally inwardly open opposed jaw recesses 34 at front ends 12*a* and forwardly of the pin openings 24, and laterally inwardly facing cam surfaces 35 at rear ends 12*b* and rearwardly of the pin openings 24. In addition, each jawarm further includes at least one inwardly extending tooth member 36 defined by the inner edge 32 at the distal front end 12*a* and forwardly of the pin openings 24.

The inner sides 32 of the jawarm members 12 receive and support a biasing member 50 preferably in the form of an elongate spring member 51 extending between opposed inwardly directed cylindrical pockets 40 formed in the jawarm members inwardly and forwardly of the pin openings 24. Although a coil spring is illustrated, it is to be appreciated that other forms of biasing means or devices can be used as well to urge the jawarms into selected respective positions or orientations as desired, such as, for example, flat springs or non-traditional springs such as urethane members and others. In addition to holding the spring member 51, the inner edges 32 of the jawarm members receive and support a circular timing disk member 60 held between corresponding substantially circular pockets 42 defined by the inner edges 32 of the jawarms laterally inwardly of pin openings 24 and slightly rearwardly thereof. The timing disk 60 is essentially free floating between the opposed pockets 42. The position of the pockets 42 relative to the pin openings 24 is selected to strike an acceptable balance in the amount of pocket opening holding the disk 60 in place between the fully opened and fully closed positions of the jawarm members. The spring member 51 is preferably held in place under compression forward of the pin openings thereby biasing the front or distal ends 12*a* of the jawarm members 12 into opposite directions towards the opened orientation illustrated in FIG. 2.

It is to be appreciated that in the absence of an external force applied to the jawset 10, the jawarm members 12 are preferably returned to an open or relaxed position for receiving an uncrimped clamp (not shown) into the workpiece alignment area 100 for processing the workpiece in a primary operation using the tooth members 36 and in a secondary operation using a punch member 70 to be described in greater detail below. The spring member 51 is preferably under compression in the arrangement shown to spread the front jawarm ends 12*a* apart. However, if desired, the biasing member 50 can be modified such as by using it relative to the pivot points of the arm or by redirecting it such as by using a spring under tension to bias the rear ends 12*b* of the jawarms into a closed position.

Figure 5A:
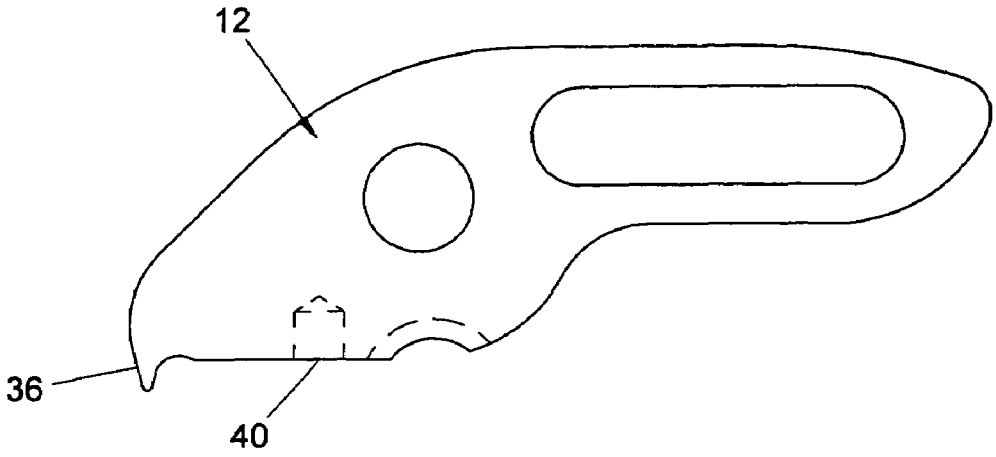
FIGS. 5*a* and 5*b* are top and side plan views of a jawarm member of the jawset of FIGS. 1-4.
Figure 5B:
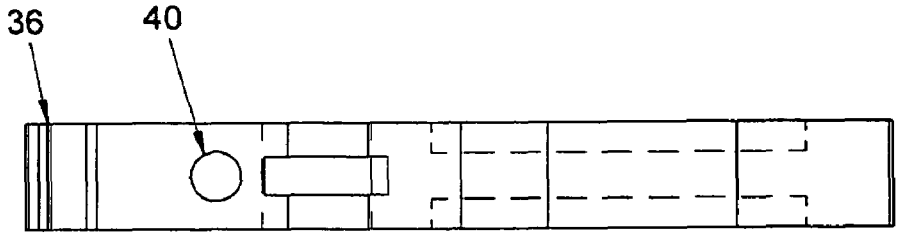
Figure 5C:
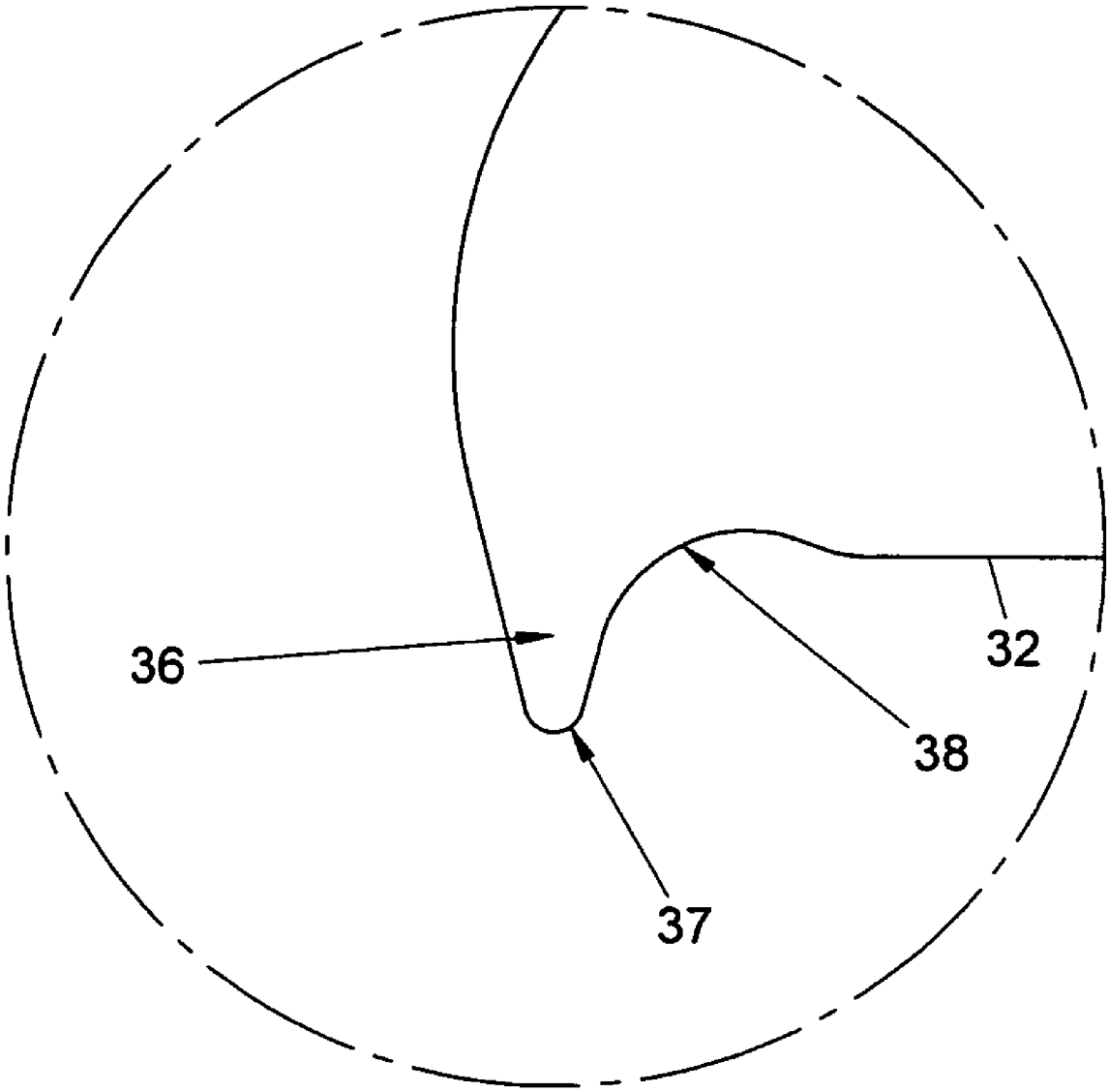
FIG. 5*c* is an enlarged top plan view of a portion of FIG. 5*a;*

It is to be appreciated that, as noted above, the subject jawset 10 is configured to effect first and second operations on an associated workpiece, preferably crimping and punching operations on an associated clamp type workpieces. With regard initially to the first or primary crimping operation, FIG. 5*c* best shows a preferred profile of a tooth member 36 formed by the inner edge 32 of one of the jawarm members 12. As shown there, the tooth member 36 includes a rounded convex nose portion 37 adapted to engage under the ears of an associated clamp ring (not shown) and an inwardly directed concave portion 38 configured to support the nose portion 37 relative to the front end 12*a* of the jawarm and to distribute force generated during use of the subject jawset. In the first embodiment illustrated, the nose portion 37 defines a radius of about 0.025 inches and the inwardly directed concave portion 38 defines a radius of about 0.130 inches. These dimensions have been found to be particularly well suited for application of the subject jawset 10 on a crimp ring having a standard size of about ⅜-1 inch. It is to be appreciated that although the preferred shape and configuration of the tooth members 36 formed by the jawarms is as illustrated in FIG. 5*c* and specified above, the shape and/or configuration is selectable as necessary or desired for crimping the associated workpiece. Therefore, the precise dimensions of the tooth members are selectable as desired.

Figure 3A:
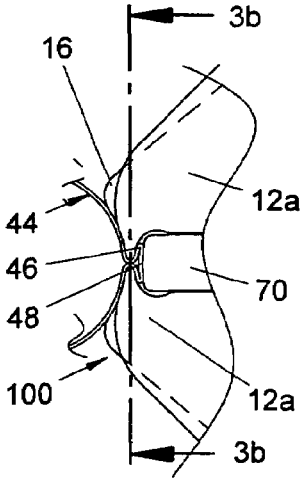
FIG. 3*a* is an enlarged portion of FIG. 3 showing engagement with an associated ring clamp.
Figure 3B:
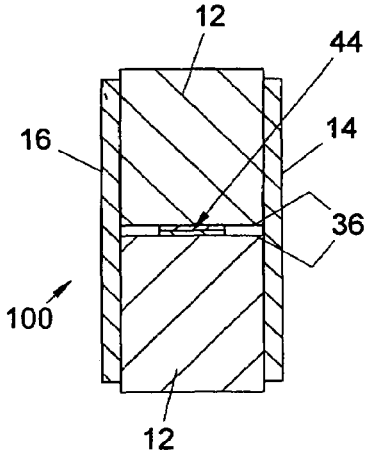
FIG. 3*b* is a cross-sectional view taken through line 3*b*-3*b* of FIG. 3*a;*
Figure 3C:
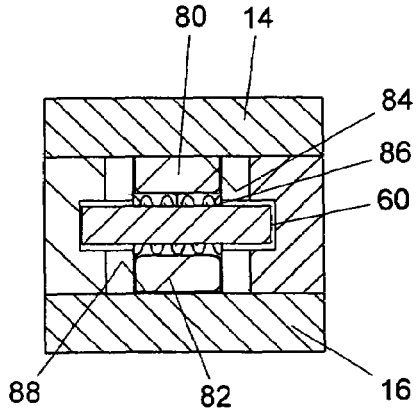
FIG. 3*c* is a cross-sectional view taken through line 3*c*-3*c* of FIG. 3.
Figure 4:
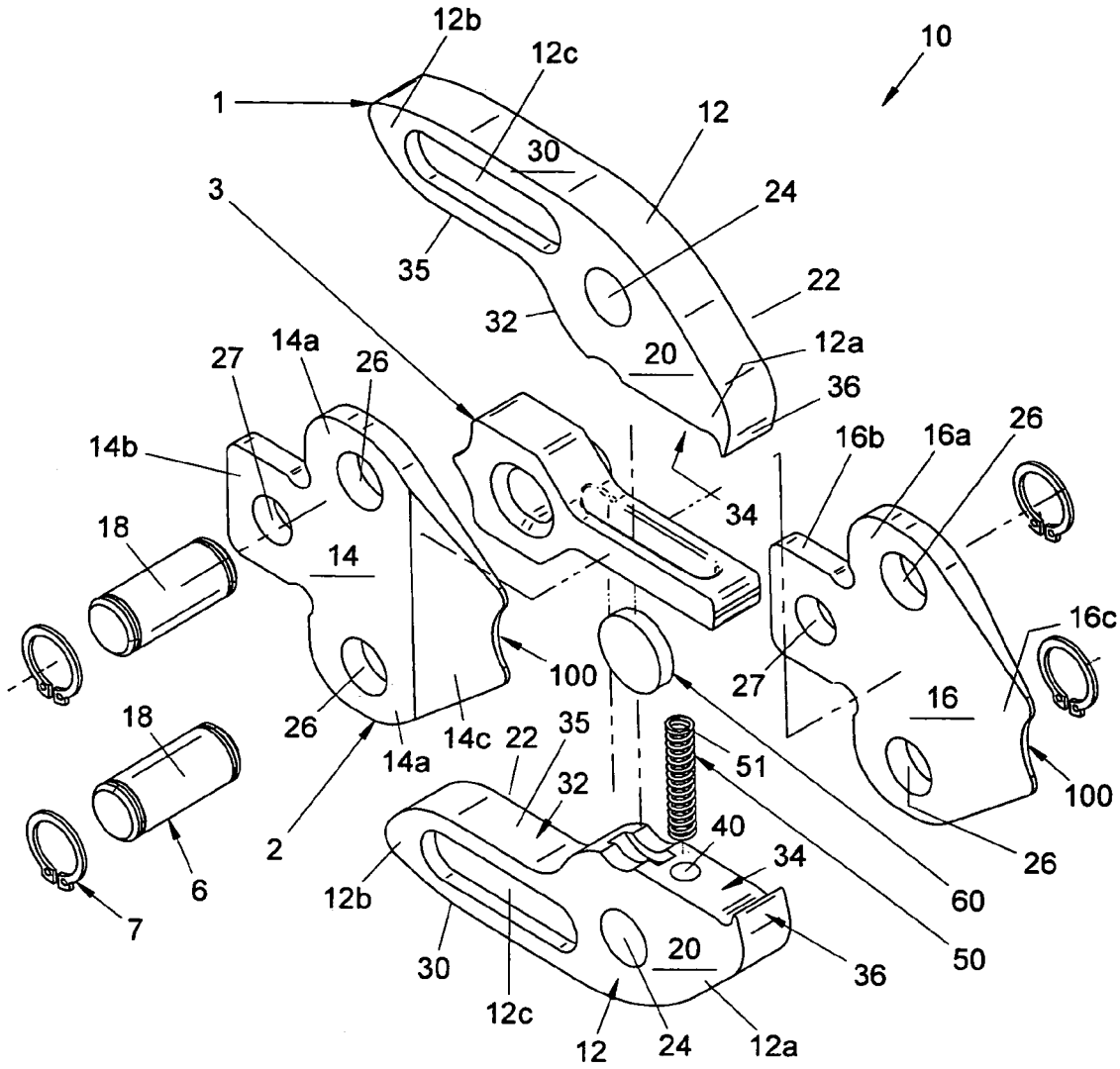
FIG. 4 is an exploded perspective view of the jawset of FIGS. 1-3 in accordance with a first embodiment.

As noted above, the subject jawset 10 is configured to perform a primary crimping operation on an associated clamp ring workpiece as well as to perform a secondary punching operation thereto. The jawset also selectively provides a fixed stop used during pressing to help shape large workpieces prior to the punch operation. FIG. 3 shows the jawset 10 in the crimped and pressed orientation. FIGS. 3*a* and 3*b* show an associated clamp ring 44 having ears 46 compressed circumferentially and held firmly crimped between the tooth members 36 during the primary crimping operation performed substantially in a direction C and having a head 48 compressed into the position illustrated in a secondary punching operation performed substantially in a direction D transverse the crimping direction C. As is clear from the drawings, the crimping operation in the crimp direction C is performed by the tooth members 36 acting on the ears 46 of the clamp ring 44 and the punching operation in the punch direction D is performed by the punch member 70 acting on the head 48 of the clamp ring 44. FIGS. 8*a*-8*d* show use of the jawset to provide both a fixed stop as well as a movable press operation and will be described below.

With reference again to the drawing FIGS. 2-7*b*, the punch member 70 extends between the pair of side plates 14 and 16 and between the pair of jawarms 12. The punch member defines a distal end 72 terminating at a pressing surface 74 and a proximal end 76 which is, in the preferred form illustrated, enlarged relative to the distal end 72. An elongate slot 78 is defined at the distal end 72 of the punch member 70 for purposes of receiving the timing disk member 60 and spring member 50 therethrough.

In accordance with an aspect of the present application, the timing disk member 60 is advantageously used to coordinate pivotal movement of the jawarms 12 about pins 18 during the primary crimping operation without interfering with the movement of the punch member during the secondary punching operation. More particularly, the punch member 70 is selectively translated along its longitudinal axis L in response to application of an external force F (FIGS. 2 and 3) from the retracted position shown in FIG. 2 to the extended or pressed position shown in FIGS. 3 and 3*a*-3*c* independent of movement of the jawarms. The punch member is guided in substantial part by slidable contact with the inner edges 35 of the jawarms 12 and with the top and bottom side plates 14, 16. In accordance with the preferred embodiments, slidable contact may also occur between the punch member 70 and two opposite face surfaces 62, 64 of the timing disk member and may further occur between the inner edges 32 of the front ends 12*a* of the jawarms 12.

Figure 6:
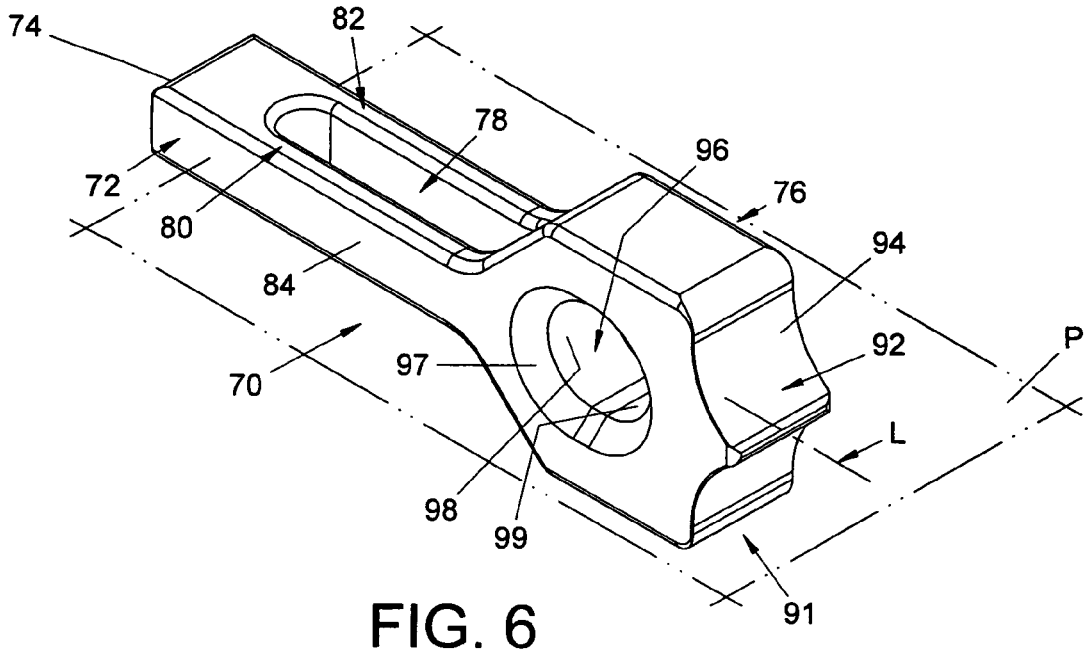
FIG. 6 is a perspective view of a punch member in accordance with the first embodiment of the jawset shown in FIG. 2.
Figure 7A:
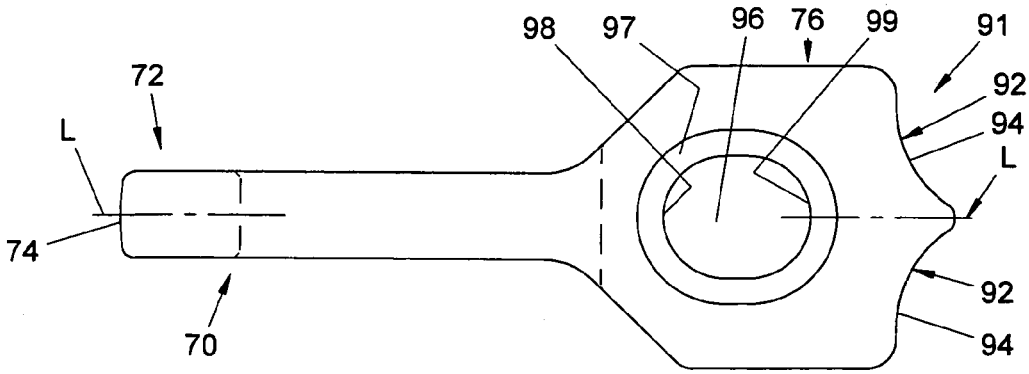
FIGS. 7*a* and 7*b* are top and side plan views showing the punch member of FIG. 7.
Figure 7B:
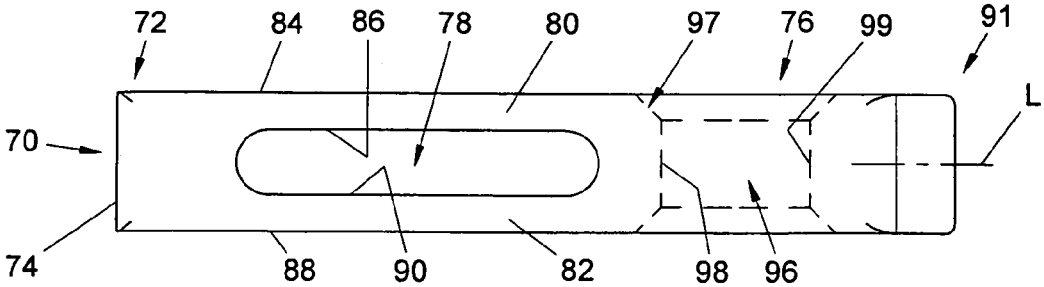

In its preferred form and as best shown in FIGS. 6, 7*a* and 7*b*, the distal end 72 of the punch member 70 includes spaced apart parallel shoulder portions 80, 82 defining the elongate slot 78 therebetween. The first shoulder portion 80 defines an outer surface 84 adapted to slidably engage the underside of the top side plate 14 and an inner surface 86 opposite from the outer surface 84 and configured to slidably engage a first face surface 62 of the timing disk. Similarly, the second shoulder portion 82 defines an outer surface 88 adapted to slidably engage the underside of the second side plate 16, and an inner surface 90 opposite from the outer surface 88 and adapted to engage a second face surface 64 of the timing disk member 60. It is to be appreciated that although engagement between the punch member 70 and disk member 60 is established at plural surfaces, a single groove or channel (not shown) can be formed in, on, or by the distal end 72 of the punch member for slidable engagement with the disk member at a single guiding interface. In the preferred embodiment illustrated, however, the disk member 60 spans the jawarm members 12 and extends completely through the elongate slot 78 with the shoulder portions 80, 82 of the punch member 90 in turn surrounding the disk member 60 on top and bottom, the shoulder portions 80, 82 being then in turn surrounded from above and below by the top and bottom side plates 14 and 16.

Further in connection with the punch member 70, the proximal end 76 of the punch member 70 includes a force receiving portion 91 adapted for engagement with the force generating member A of the associated pressing apparatus 2 as shown schematically in FIGS. 2 and 3. In the embodiment illustrated, the force receiving portion 91 is configured for operative use with a force generating member A of the type including a pair of spaced apart hardened roller members 9' carried on a movable beam 8'. To that end, a set of pocket regions 92 are preferably defined at the proximal end 76 on opposite sides of the longitudinal axis L extending along the length of the punch member. In their preferred form, the pocket regions define a pair of concave surfaces 94 facing rearwardly of the pin members 18 in the assembled condition of the jawset 10 and having a radius configured to substantially match or approximate the outer radius of the force generating roller members 9' in a manner substantially as shown in FIG. 3. Although any form of force receiving area can be provided on the proximal end 76 of the punch member 70 without departing from the spirit of the inventive concepts contained in this application, such as for example a flat force receiving area, the preferred engagement area is as illustrated for use with associated pressing apparatus 2 having a pair of spaced apart rotatable disks 9' such as commonly used in the industry. The concave surfaces 94 are symmetrical about a plane P extending through the longitudinal axis L defined by the punch member 70 which lies in the plane of the page in FIG. 7*a* and perpendicularly out from the page in the view of FIG. 7*b*. The force generating member A and roller members 9' form no part of the present application and are discussed only to help describe the preferred jawset embodiments.

In use, the jawset 10 is mounted to the connection unit 4 of the associated pressing apparatus 2 by extending the connection bolt 8 through the pin openings 24 in the top and bottom side plates as well as through an elongated rear opening 96 having a chamfered edge surface 97 and defining first and second concave stop surfaces 98, 99. The first stop surface 98 is rearwardly oriented from the distal end 72 toward the proximal end 76 and the second stop surface 99 is forwardly oriented from the proximal end 76 toward the distal end 72 of the punch member 70 substantially as shown. The concave stop surfaces 98, 99 are preferably contoured to closely approximate the outer radius of the connection bolt 8 extending through the top and bottom side plates 14 and 16 as well as through the punch member 70. The stop surfaces are provided for limiting the travel extent of the punch member 70 relative to the front end 12*a* of the jaw members 12 to obtain first and second predetermined first and second relationships between the pressing surface 74 defined at the distal end 72 of the punch member 70 and the opposed nose and concave portions 37 and 38 of the tooth members 36 to provide a fixed stop to help shape large workpieces during the crimping operation and to provide the desired secondary pressing operation to the head 48 of the ring clamp 44. The chamfered edge surface 97 is provided to help guide the lead end of the associated connection bolt 8 through the opening 96 regardless of the position of the punch member 70 relative to the side plates 14, 16. FIG. 3 shows the subject jawset 10 after fully completing both the primary crimping operation as well as the secondary pressing operation.

Movement of the subject jawset 10 from the opened position illustrated in FIG. 2 to the closed position illustrated in FIG. 3 and then back to the opened position is accomplished by actuating the pressing apparatus 2 such as by movement of a trigger switch to cause motion of the force generating member 9 relative to the connection bolt 8. Initially, ends 12*a* of the jawarm members are biased apart by the spring member 51 to open the jaws for receiving an associated clamp ring between the tooth members 36. Opposite ends 12*b* of the jawarm members are initialized at the position shown in FIG. 2 by pivotal movement of the arms about the pivot pins 18. Opposed inwardly facing portions of the side plates 14, 16 adjacent the tooth members 36 form a workpiece alignment area 100 (FIG. 3*c*) for providing relative alignment between the clamp 44 carried on an associated hose or the like and the jawset during use. After receiving the workpiece into the jawarms, the drive unit is then actuated for the cam rollers 9' thereon to advance axially forwardly of the jawset and simultaneously engage against cam surfaces 35 to generate a force F' outwardly displacing the rear ends 12*a* of the jawarm members 12 about the pivot pins 18 for the tooth members 36 to move inwardly in turn crimping the associated clamp ring 44 therebetween substantially in a crimping direction C. In addition, translation of the cam roller 9' urges the punch member 70 linearly along the longitudinal axis L thereof to effect a second or punch operation by contact of the pressing surface 74 on the distal end 72 of the punch member 70 with the associated clamp ring 44 substantially along a punching direction D transverse the crimping direction C. FIG. 3 shows the subject jawset in a fully closed or crimped and punched position and FIG. 3*a* shows an associated clamp 44 received in the jawset after the crimping and pressing operations. Thereafter, the actuated drive unit withdraws the cam rollers 9', and the jawarm members are again manually displaced by the bias effect of the spring 51 to open the jaw recesses for removal of the jawset from the crimped and punched clamp ring 44.

Figure 8A:
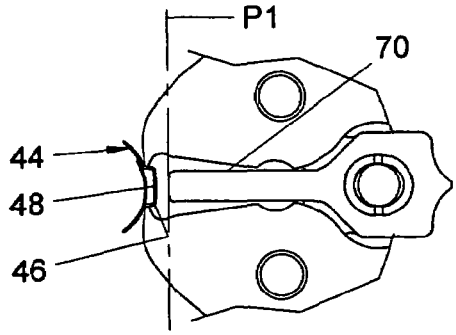
FIGS. 8*a*-8*d* are a sequence of plan views of the subject jawset showing engagement with an associated large ring clamp showing hard stop and intermediate punch positions.

FIGS. 8*a*-8*d* are a set of plan views of the subject jawset to illustrate a sequence of operating the jawset with an associated large sized clamp ring 44 e.g. a one inch clamp ring. An additional advantage provided by the embodiments of the present application enable use of the punch member of the subject jawset to provide both a hard stop as well as a movable pressing operation using the pressing surface of the punch member 70. Initially, as illustrated in FIG. 8*a*, with the jaw members in an opened or relaxed position, an associated clamp ring 44 is received between the teeth of the jawarms with the punch member in a somewhat random position substantially as shown. As discussed above, the opening 96 extending through the proximal end of the punch member is elongated enabling the punch member to move longitudinally relative to the jawarms and relative to the associated connection bolt. In the orientation illustrated in FIG. 8*a*, the jaws are opened and the punch member 70 is located at an initial random position P1.

Figure 8B:
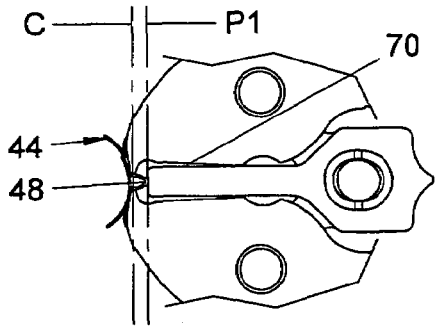

Next, in FIG. 8*b*, a crimp operation is initiated in a manner described above whereby the ends of the jawarms are actuated in the crimping direction C to thereby compress a portion of the associated clamp ring 44 together. This in turn causes the head 48 of the associated clamp member to bulge in a direction away from the tooth members of the jawarms and into contact with the pressing surface of the loosely held punch member 70. The crimp operation is in process in the arrangement shown in FIG. 8*b* and the head 48 of the associated clamp ring 44 has just begun to touch the pressing surface of the punch member 70.

Figure 8C:
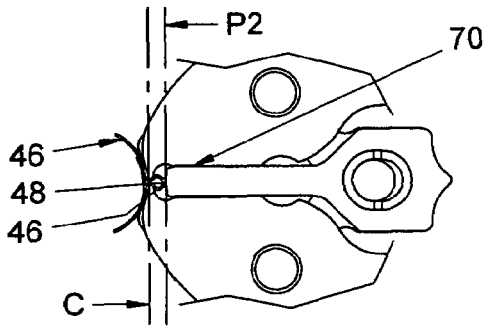

Next, continued actuation of the jawarms in the crimping direction C effects a crimping of the associated clamp ring adjacent the ears 46 and further causing the head 48 to push against the punch member 70 to the right in the figure. As described above, the elongate opening 96 includes a first stop surface 98 rearwardly oriented from the distal end toward the proximal end for engaging the associate connection bolt. A dimension between the pressing surface 74 and the first stop surface 98 of the punch member 70 is selected such that a hard stop is provided for limiting inward movement of the punch member (to the right in the drawing) by contact between the first stop surface 98 and the associated connection bolt 8 causing the punch member 70 to be immovable to the right in the drawing in a hard stop position P2. Simply, the punch member 70 is held in place against a reactionary force generated by the head 48 of the clamp ring 44 during the crimping operation as shown in FIG. 8*c*. This helps form the head 48 of the workpieces and prepare the head for a subsequent press operation such as shown in FIG. 8*d*.

Figure 8D:
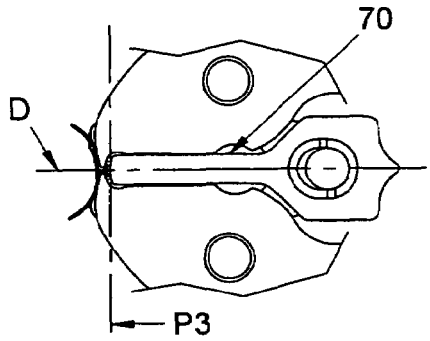

Turning now to that figure, as described above, the punch member is actuated by movement of the associated force generating member to the left as shown in FIG. 8*d* to effect a pressing operation in a pressing direction D. Movement of the punch member 70 in the pressing direction D is limited by engagement of the associated connection bolt 8 with the second concave stop surface 99 described above. The second stop surface 99 is forwardly oriented from the proximal end toward the distal end of the punch member during the pressing operation in a pressing direction D is controlled to terminate at a hard stop pressing location P3.

It is to be appreciated that relatively small clamp rings might not have sufficient size to cause the head thereof to urge the punch member 70 fully to the hard stop position P2 shown in FIG. 8*c*. For those workpieces, however, it is less critical to preform the head prior to the pressing operation as little deformation occurs and the punch member is likely to flatten the head of the clamp ring and bend the ears thereof evenly and sufficiently to the hard stop press position P3 shown in FIG. 8*d*.

FIGS. 9 and 10 show a second embodiment of the subject jawset 10' with first and second auxiliary side plate members 14' and 16' carried on the jawset on sides of the first side plates 14 and 16 opposite from the jawarms 12. As shown in those figures, the auxiliary side plates 14' and 16' are preferably formed from a contoured stamping and include inwardly directed lead ends 110 forming an alignment area 100' in accordance with the second embodiment. The inwardly directed lead ends 110 include forwardly directed concave surfaces 112 adapted to engage an associated tube or other structure upon which the associated clamp ring 44 is to be installed. Further, the lead ends 110 include spaced apart opposed alignment surfaces 114 for engaging opposite sides of the associated clamp ring 44 for purposes of establishing relative alignment between the jawset 10' and the workpiece substantially in the manner shown in FIG. 3*b* in connection with the first embodiment. In their preferred form, the auxiliary side plates 14', 16' are made from a low cost steel. However, they can be formed of a transparent resilient plastic material as well to enhance visualization of the crimping and punching operations while the jawset 10' is in engagement with the work piece. In addition, the second embodiment enables removal of the workpiece alignment portion 100 when alignment is not critical in the application without disturbing the primary sideplates 14, 16 engaged with the jawarm members 12.

A third embodiment of the subject jawset 10" is shown and described in FIGS. 11*a*, 11*b*, 12, and 13. Turning now to those figures, a modified jawarm 12' includes a stop member 120 carried on the pair of jaw members 12' for limiting lateral inward movement of the tooth members 36' in the closing or crimping direction C. In its preferred form, the stop member 120 includes an inwardly directed abutment surface 122 carried on raised protuberances 124 formed on the inner edges 32' of the pair of jawarms 12' forwardly of the pivot pin openings 24'. The raised protuberances 124 extend into the elongate slot 78 of the punch member 70 substantially in the manner as shown and discussed above in connection with the biasing member 50 and timing member 60. It is to be appreciated that other forms of stop members can be used equivalently to limit lateral movement of the tooth members 36' such as, for example, providing stop blocks or other devices or parts on the side plates, using various pin members or the like extending through the side plates or any other means for limiting inward travel of the front ends 12*a* of the jawarms 12'.

Figure 13:
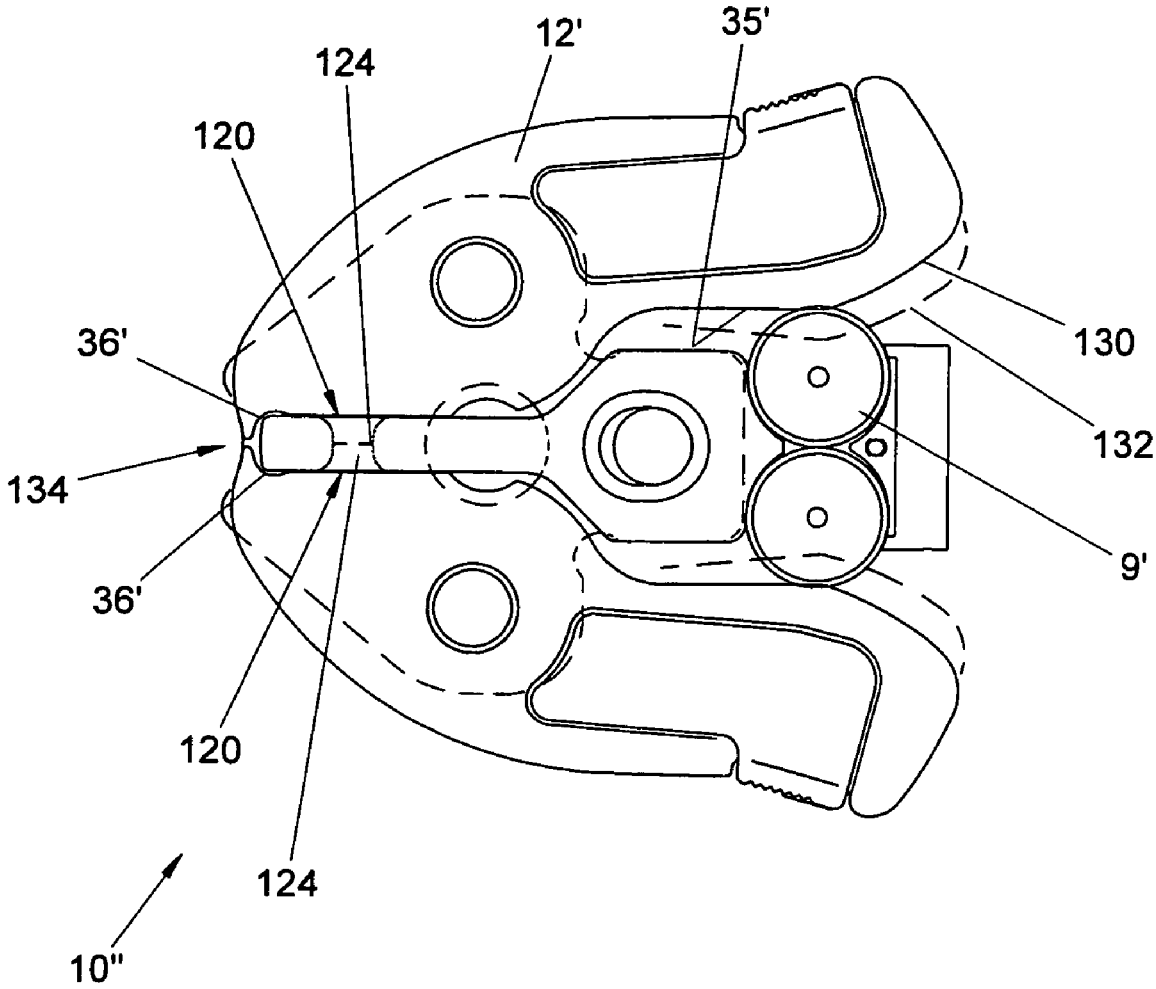

As best shown in FIG. 13, the jawarms 12' of the second embodiment of the subject jawset 10' are configured to be outwardly elastically deformed rearwardly of the pin openings 24' to a deflected condition 130 spaced from an undeflected condition 132 urged thereby by the driving force of the roller wheels 9' relative to the cam surfaces 35' when the jawset is in the closed position. Preferably, the entire jawarm 12' is elastically deformable even though only a portion thereof is illustrated in a deflected condition. Essentially, contact between the opposed abutment surfaces 122 prevent further movement of the lead ends 12*a* of the jawarms about pivot openings 24 because they present a hard stop limiting travel thereof. That is, contact between the abutment surfaces 122 forwardly of the pin openings 24 limits the lateral movement of the tooth members 36 in the close direction to provide a gap 134 therebetween having a predefined dimension. In the embodiment illustrated, the preferred dimension defined by the gap is 0.042 inches (1.06 mm).

It is to be appreciated that the third embodiment of the subject jawset 10" illustrated in FIGS. 11*a*-13 provides an alternative approach to control the gap formed between the tooth members when the jawset is in the closed position after completion of a crimping operation. In addition, the third embodiment is insensitive to wear in the drive rollers and in the pocket regions of the punch member and can also accommodate dirt and debris or other materials which might interfere with or become associated with the space between the drive roller 9' and the cam surface 35' which, but for the abutment surfaces 122, might affect the ultimate size of the gap 134 formed between the opposed tooth members 36'.

The exemplary embodiments have been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A jawset for crimping and punching an associated clamp ring workpiece, the jawset comprising:

a pair of spaced apart side plates defining a gap therebetween;

a pair of pivot pins extending transversely between the side plates;

a pair of jaw arms disposed between said pair of side plates in said gap, the pair of jaw arms having pivot pin openings receiving said pivot pins between said side plates, each jaw arm having inner and outer edges laterally spaced from and extending forwardly, along, and rearwardly of the corresponding pivot pin opening, said inner edges including laterally inwardly directed tooth members and laterally inwardly open opposed jaw recesses forwardly of the pivot pin openings and inwardly facing cam surfaces rearwardly of the openings, the jaw arms during use of the jawset being pivotable about the pivot pins in response to first forces laterally outwardly against the cam surfaces to displace the tooth members laterally inwardly in a first direction to crimp said associated clamp ring workpiece;

a punch member extending between said pair of side plates and between said pair of jaw arms, the punch member having a distal end defining an elongate slot and an enlarged proximal end, the punch member during use of the jawset being selectively movable along a longitudinal axis rearwardly in response to a workpiece reactionary force against said distal end during said crimp and forwardly in response to a second force against said enlarged proximal end to slide the distal end forwardly along said inner edges of said pair of jaw arms extending forwardly of the pivot pin openings to punch the associated workpiece in a second direction transverse said first direction; and, a timing disk carried in opposed first and second recesses formed in said inner edges of said pair of jaw arms and extending in said elongate slot defined by said punch member, the timing disk synchronizing relative movement of said pair of jaw arms when a one of said pair of jaw arms is rotated relative to said other of said pair of jaw arms in response to said first forces laterally outwardly against the cam surfaces.

2. The jawset according to claim 1 wherein:

said distal end of the punch member includes spaced apart shoulder portions;

the first shoulder portion defines an outer surface adapted to slidably engage a first side plate of said pair of side plates, and an inner surface opposite from said outer surface and configured to slidably engage a first side of said timing disk; and, the second shoulder portion defines an outer surface adapted to slidably engage a second side plate of said pair of side plates, and an inner surface opposite from said outer surface and adapted to engage a second side of said timing disk opposite said first side of the timing disk.

3. The jawset according to claim 2 wherein said punch member is guided in said gap between said pair of spaced apart side plates by said timing disk in said elongate slot.

4. The jawset according to claim 2 wherein:

said elongate slot of said punch member is an opening extending completely through said distal end; and, said timing disk is a single circular member extending between said first and second opposed recesses and through said opening of said punch member.

5. The jawset according to claim 1 further including:

a biasing member operatively coupled with said pair of jaw arms for urging said pair of jaw arms in an opening direction opposite said closing direction.

6. The jawset according to claim 5 wherein:

said pair of jaw arms include third and fourth opposed recesses adjacent said first and second opposed recesses; and, said biasing member is a coil spring having ends received in said third and fourth recesses and extending through said elongate slot of said punch member.

7. The jawset according to claim 1 further including:

a workpiece alignment portion defined by said pair of spaced apart side plates in a region adjacent said tooth members of said pair of jaw arms, the alignment portion being configured to expose a portion of said tooth members for visual inspection and for positioning said associated workpiece relative to said tooth members during use of said jawset.

8. The jawset according to claim 7 wherein: each of said side plates includes a pair of concave portions defined at edges thereof located forwardly of the pivot pins.

9. The jawset according to claim 1 wherein:

the enlarged proximal end of the punch member defines a set of pocket regions adapted to receive said second forces from an associated source to selectively move the punch member forwardly.

10. The jawset according to claim 9 wherein:

the set of pocket regions includes a pair of concave surfaces adapted to engage an associated set of roller members generating said second forces, the pair of concave surfaces being bi-laterally symmetrical about a plane extending along a longitudinal axis defined by said distal end of the punch member.

11. The jawset according to claim 1 further including: a pair of auxiliary side plates carried on said pivot pins adjacent said side plates on sides opposite said jawarm members.

12. The jawset according to claim 11 further including:

a workpiece alignment portion defined by said pair of auxiliary side plates in a region adjacent said tooth members of said jawarms, the alignment portion being configured to expose a portion of said tooth member for visual inspection and for positioning said associated workpiece relative to said tooth members during use of said jawset.

13. The jawset according to claim 12 wherein:

each of said auxiliary side plates includes a pair of concave portions defined at edges thereof located forwardly of the pivot pins.

14. The jawset according to claim 1 further including:

a stop member carried on said pair of jaw members for limiting said lateral inward movement of said tooth members in said closing direction.

15. The jawset according to claim 14 wherein:

said stop member includes inwardly directed abutment surfaces carried on raised protuberances formed on said inner edges of said pair of jaw arms forwardly of said pivot pin openings.

16. The jawset according to claim 15 wherein said raised protuberances extend into said elongate slot of said punch member.

17. The jawset according to claim 16 wherein:

said jawarms are configured to be outwardly deflected rearwardly of said pin openings to a deflected condition; and, contact between said abutment surfaces forwardly of said pin openings limits said lateral movement of said tooth members in said closing direction while said jawarms rearwardly of said pin openings are in said deflected condition to provide a gap therebetween having a predefined dimension.

18. The jawset according to claim 1 wherein the enlarged proximal end of the punch member defines an elongate opening adapted to receive an associated holding pin member of a driving tool when the jawset is selectively coupled with the driving tool.

19. The jawset according to claim 18 wherein:

said elongate opening includes opposed first and second concave stop surface adapted to engage said associated holding pin member during use of the jawset, said first stop surface selectively engaging said associated holding pin member to limit rearward movement of the punch member relative to said jawarms in response to a workpiece reactionary force against said distal end during said crimp and said second stop surface selectively engaging said associated holding pin member to limit forward movement of the punch member relative to said jawarms in response to said second force against said proximal end during said press.

20. A tool for crimping and punching an associated clamp ring workpiece, the tool comprising:

a pair of spaced apart side plates defining a gap therebetween;

a pair of pivot pins extending transversely between the side plates;

a pair of jaw arms disposed between said pair of side plates in said gap, the pair of jaw arms having pivot pin openings receiving said pivot pins between said side plates, each jaw arm having inner and outer edges laterally spaced from and extending forwardly, along, and rearwardly of the corresponding pivot pin opening, said inner edges including laterally inwardly directed tooth members and laterally inwardly open opposed jaw recesses forwardly of the pivot pin openings and inwardly facing cam surfaces rearwardly of the openings, the jaw arms during use of the tool being pivotable about the pivot pins in response to first forces laterally outwardly against the cam surfaces to displace the tooth members laterally inwardly in a first direction to crimp said associated clamp ring workpiece; and, a punch member extending between said pair of side plates and between said pair of jaw arms, the punch member having a distal end and an enlarged proximal end, the punch member during said use of the tool being selectively movable along a longitudinal axis i) rearwardly towards a predefined hard stop position during said crimping and while said tooth members are being displaced laterally inwardly in said first direction and ii) forwardly in response to a second force against said enlarged proximal end to punch the associated workpiece in a second direction transverse said first direction.

21. The tool according to claim 20 further including a timing disk carried in opposed first and second recesses formed in said inner edges of said pair of jaw arms and extending in said elongate slot defined by said punch member, the timing disk synchronizing relative movement of said pair of jaw arms when a one of said pair of jaw arms is rotated relative to said other of said pair of jaw arms in response to said first forces laterally outwardly against the cam surfaces, and wherein:

said distal end of the punch member includes spaced apart shoulder portions;

the first shoulder portion defines an outer surface adapted to slidably engage a first side plate of said pair of side plates, and an inner surface opposite from said outer surface and configured to slidably engage a first side of said timing disk; and, the second shoulder portion defines an outer surface adapted to slidably engage a second side plate of said pair of side plates, and an inner surface opposite from said outer surface and adapted to engage a second side of said timing disk opposite said first side of the timing disk.

22. The tool according to claim 20 further including:

a workpiece alignment portion defined by said pair of spaced apart side plates in a region adjacent said tooth members of said pair of jaw arms, the alignment portion being configured to expose a portion of said tooth members for visual inspection and for positioning said associated workpiece relative to said tooth members during use of said tool.

23. The tool according to claim 20 wherein:

the enlarged proximal end of the punch member defines a set of pocket regions adapted to receive said second forces from an associated source to selectively move the punch member forwardly.

24. The tool according to claim 20 further including:

a pair of auxiliary side plates carried on said pivot pins adjacent said side plates on sides opposite said jawarm members.

25. The tool according to claim 20 further including:

a stop member carried on said pair of jaw members for limiting said lateral inward movement of said tooth members in said closing direction.

26. The tool according to claim 25 wherein:

said stop member includes inwardly directed abutment surfaces carried on raised protuberances formed on said inner edges of said pair of jaw arms forwardly of said pivot pin openings.

27. The tool according to claim 26 wherein:

said jawarms are configured to be outwardly deflected rearwardly of said pin openings to a deflected condition; and, contact between said abutment surfaces forwardly of said pin openings limits said lateral movement of said tooth members in said closing direction while said jawarms rearwardly of said pin openings are in said deflected condition to provide a gap therebetween having a predefined dimension.

28. The tool according to claim 20 wherein the enlarged proximal end of the punch member defines an elongate opening defining said predefined hard stop position and being adapted to receive an associated holding pin member of a driving tool when the tool is selectively coupled with the driving tool.

29. The tool according to claim 28 wherein:

said elongate opening includes opposed first and second concave stop surfaces adapted to engage said associated holding pin member during use of the tool, said first stop surface selectively engaging said associated holding pin member to limit said rearward movement of the punch member relative to said jawarms in response to a workpiece reactionary force against said distal end during said crimp and said second stop surface selectively engaging said associated holding pin member to limit forward movement of the punch member relative to said jawarms in response to said second force against said proximal end during said press.

30. A tool for crimping an associated clamp ring workpiece, the tool comprising:

a pair of spaced apart side plates defining a gap therebetween;

a pair of pivot pins extending transversely between the side plates;

a pair of jaw arms disposed between said pair of side plates in said gap, the pair of jaw arms having pivot pin openings receiving said pivot pins between said side plates, each jaw arm having inner and outer edges laterally spaced from and extending forwardly, along, and rearwardly of the corresponding pivot pin opening, said inner edges including laterally inwardly directed tooth members and laterally inwardly open opposed jaw recesses forwardly of the pivot pin openings and inwardly facing cam surfaces rearwardly of the openings, the jaw arms during use of the tool being pivotable about the pivot pins in response to first forces laterally outwardly against the cam surfaces to displace the tooth members laterally inwardly in a first direction to crimp said associated clamp ring workpiece; and, a punch member extending between said pair of side plates and between said pair of jaw arms, the punch member having a distal end and an enlarged proximal end, the punch member during said use of the tool being selectively movable along a longitudinal axis rearwardly towards a predefined hard stop position during said crimping and while the tooth members are being displaced laterally inwardly in the first direction.

31. The tool according to claim 30 further including a timing disk a timing disk carried in opposed first and second recesses formed in said inner edges of said pair of jaw arms and extending in said elongate slot defined by said punch member, the timing disk synchronizing relative movement of said pair of jaw arms when a one of said pair of jaw arms is rotated relative to said other of said pair of jaw arms in response to said first forces laterally outwardly against the cam surfaces, and wherein:

said distal end of the punch member includes spaced apart shoulder portions;

the first shoulder portion defines an outer surface adapted to slidably engage a first side plate of said pair of side plates, and an inner surface opposite from said outer surface and configured to slidably engage a first side of said timing disk; and, the second shoulder portion defines an outer surface adapted to slidably engage a second side plate of said pair of side plates, and an inner surface opposite from said outer surface and adapted to engage a second side of said timing disk opposite said first side of the timing disk.

32. The tool according to claim 30 further including:

a workpiece alignment portion defined by said pair of spaced apart side plates in a region adjacent said tooth members of said pair of jaw arms, the alignment portion being configured to expose a portion of said tooth members for visual inspection and for positioning said associated workpiece relative to said tooth members during use of said tool.

33. The tool according to claim 30 wherein:

the enlarged proximal end of the punch member defines a set of pocket regions adapted to receive said second forces from an associated source to selectively move the punch member forwardly.

34. The tool according to claim 30 further including:

a pair of auxiliary side plates carried on said pivot pins adjacent said side plates on sides opposite said jawarm members.

35. The tool according to claim 30 further including:

a stop member carried on said pair of jaw members for limiting said lateral inward movement of said tooth members in said closing direction.

36. The tool according to claim 35 wherein:

said stop member includes inwardly directed abutment surfaces carried on raised protuberances formed on said inner edges of said pair of jaw arms forwardly of said pivot pin openings.

37. The tool according to claim 36 wherein:

said jawarms are configured to be outwardly deflected rearwardly of said pin openings to a deflected condition; and, contact between said abutment surfaces forwardly of said pin openings limits said lateral movement of said tooth members in said closing direction while said jawarms rearwardly of said pin openings are in said deflected condition to provide a gap therebetween having a predefined dimension.

38. The tool according to claim 30 wherein the enlarged proximal end of the punch member defines an elongate opening defining said predefined hard stop position and being adapted to receive an associated holding pin member of a driving tool when the tool is selectively coupled with the driving tool.

39. The tool according to claim 38 wherein:

said elongate opening includes opposed first and second concave stop surfaces adapted to engage said associated holding pin member during use of the tool, said first stop surface selectively engaging said associated holding pin member to limit said rearward movement of the punch member relative to said jawarms in response to a workpiece reactionary force against said distal end during said crimp and said second stop surface selectively engaging said associated holding pin member to limit forward movement of the punch member relative to said jawarms in response to said second force against said proximal end during said press.

* * * * *